US011029011B2

(12) United States Patent
Li et al.

(10) Patent No.: US 11,029,011 B2
(45) Date of Patent: Jun. 8, 2021

(54) LAMP SOCKET CONNECTOR, LIGHTING DEVICE AND LIGHTING SYSTEM

(71) Applicant: OPPLE LIGHTING CO., LTD., Shanghai (CN)

(72) Inventors: Feng Li, Shanghai (CN); Xuejun Feng, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/690,635

(22) Filed: Nov. 21, 2019

(65) Prior Publication Data

US 2020/0088394 A1 Mar. 19, 2020

Related U.S. Application Data

(63) Continuation of application No. PCT/CN2018/081618, filed on Apr. 2, 2018.

(30) Foreign Application Priority Data

May 25, 2017 (CN) ..... 201710377509.1
May 25, 2017 (CN) ..... 201720591646.0

(51) Int. Cl.

| | |
|---|---|
| ***F21V 23/06*** | (2006.01) |
| ***H01R 13/207*** | (2006.01) |
| ***H01R 13/506*** | (2006.01) |
| ***H01R 33/76*** | (2006.01) |
| *F21Y 115/10* | (2016.01) |

(52) U.S. Cl.

CPC ..... *F21V 23/06* (2013.01); *H01R 13/207* (2013.01); *H01R 13/506* (2013.01); *H01R 33/765* (2013.01); *H01R 33/7664* (2013.01); *F21Y 2115/10* (2016.08)

(58) Field of Classification Search

CPC ..... F21K 9/23–238; H01R 33/00; H01R 33/05–065; F21V 23/06

See application file for complete search history.

(56) References Cited

U.S. PATENT DOCUMENTS 7,294,006 B1 * 11/2007 Chen ..... H01R 13/631 439/257
7,654,854 B1 * 2/2010 Yang ..... H01R 4/4827 439/419
2011/0305012 A1 12/2011 Lo (Continued)

FOREIGN PATENT DOCUMENTS

CN 101900253 A 12/2010
CN 201680309 U * 12/2010

(Continued)

OTHER PUBLICATIONS

International Search Report (including English translation) and Written Opinion issued in PCT/CN2018/081618, dated Jun. 21, 2018, 13 pages.

*Primary Examiner* — Mariceli Santiago
(74) *Attorney, Agent, or Firm* — Arch & Lake LLP

(57) ABSTRACT

The present disclosure discloses a lamp socket connector, a lighting device and a lighting system. The lamp socket connector includes a docking portion. The docking portion includes a docking port for docking a light source module, a docking channel extending from the docking port, and at least two socket terminals in the docking channel.

19 Claims, 10 Drawing Sheets

(56) References Cited

U.S. PATENT DOCUMENTS

| | | | | |
|---|---|---|---|---|
| 2015/0233562 | A1* | 8/2015 | Chiang | F21S 10/06<br>362/249.06 |
| 2016/0079701 | A1* | 3/2016 | Liao | H01R 33/94<br>439/39 |
| 2019/0234598 | A1* | 8/2019 | Ma | H05B 47/00 |

FOREIGN PATENT DOCUMENTS

| | | | | |
|---|---|---|---|---|
| CN | 102537819 | A | 7/2012 | |
| CN | 203036275 | U | 7/2013 | |
| CN | 105683647 | A | 6/2016 | |
| CN | 106287442 | A | 1/2017 | |
| CN | 106287443 | A | 1/2017 | |
| CN | 206018352 | U | 3/2017 | |
| CN | 107062169 | A | 8/2017 | |
| CN | 206771288 | U | 12/2017 | |
| EP | 1400749 | A2 * | 3/2004 | F21V 19/00 |
| ES | 2170025 | A1 * | 7/2002 | H01R 33/94 |
| WO | WO-2015092823 | A2 * | 6/2015 | F21S 9/024 |

* cited by examiner

LAMP SOCKET CONNECTOR, LIGHTING DEVICE AND LIGHTING SYSTEM

CROSS-REFERENCE TO RELATED APPLICATIONS

This application is based upon and claims the priority of PCT patent application No. PCT/CN2018/081618 filed on Apr. 2, 2018 which claims the priority of Chinese Patent Application No. 201710377509.1 filed on May 25, 2017, and Chinese Patent Application No. 201720591646.0 filed on May 25, 2017, the entire content of all of which is hereby incorporated by reference herein for all purposes.

TECHNICAL FIELD

The present disclosure relates to a lighting field, and more particularly, to a lamp socket connector, a lighting device and a lighting system for mounting a light source module.

BACKGROUND

A lighting system, such as indoor or outdoor decorative lights, generally comprises a mounting pedestal and a lighting device mounted on the mounting pedestal; and the lighting device includes a lamp socket connector mounted on the mounting pedestal, and a light source module mounted on the lamp socket connector. Through the lamp socket connector, the light source module can be fixed onto the mounting pedestal so that the light source module can be connected with an external power source.

SUMMARY

The present disclosure discloses a lamp socket connector, a lighting device and a lighting system.

The present disclosure provides a lamp socket connector including a docking portion. The docking portion may include: a docking port for docking a light source module, a docking channel extending from the docking port, and at least two socket terminals in the docking channel.

The present disclosure provides a lighting device. The lighting device may include a lamp socket connector that include a docking portion, where the docking portion may include: a docking port for docking a light source module; a docking channel extending from the docking port; and at least two socket terminals in the docking channel.

The lighting device may also include a light source module, where the light source module may be mounted to the docking port of the lamp socket connector; the light source module may include a light-emitting unit and at least two pins electrically connected with the light-emitting unit; and the pins may be plugged into the socket terminals; and where the light-emitting unit may be a WRGB light-emitting unit, and the light source module may include five pins which are connected with a positive electrode, a pin of a W component, a pin of an R component, a pin of a G component and a pin of a B component of the WRGB light-emitting unit.

The present disclosure provides a lighting system. The system may include a lighting device, where the lighting device may include: a lamp socket connector that may include a docking portion, where the docking portion may include: a docking port for docking a light source module; a docking channel extending from the docking port; and at least two socket terminals in the docking channel. The lighting device may include a light source module, where the light source module may be mounted to the docking port of the lamp socket connector; the light source module may include a light-emitting unit and at least two pins electrically connected with the light-emitting unit; and the pins may be plugged into the socket terminals.

The system may also include a mounting pedestal that may be in accordance with specification E14 and fixed to a preset mounting region, where the lamp socket connector in the lighting device may be mounted to the mounting pedestal.

It is to be understood that both the foregoing general description and the following detailed description are exemplary and explanatory only and are not restrictive of the present disclosure.

BRIEF DESCRIPTION OF THE DRAWINGS

The drawings illustrated here are provided for further understanding the present disclosure and constitute a part of the present disclosure, and are used for explaining the present disclosure together with the examples of the present disclosure and description of the examples, rather than used for improperly limiting the present disclosure. In the drawings.

DETAILED DESCRIPTION

Figure 1:
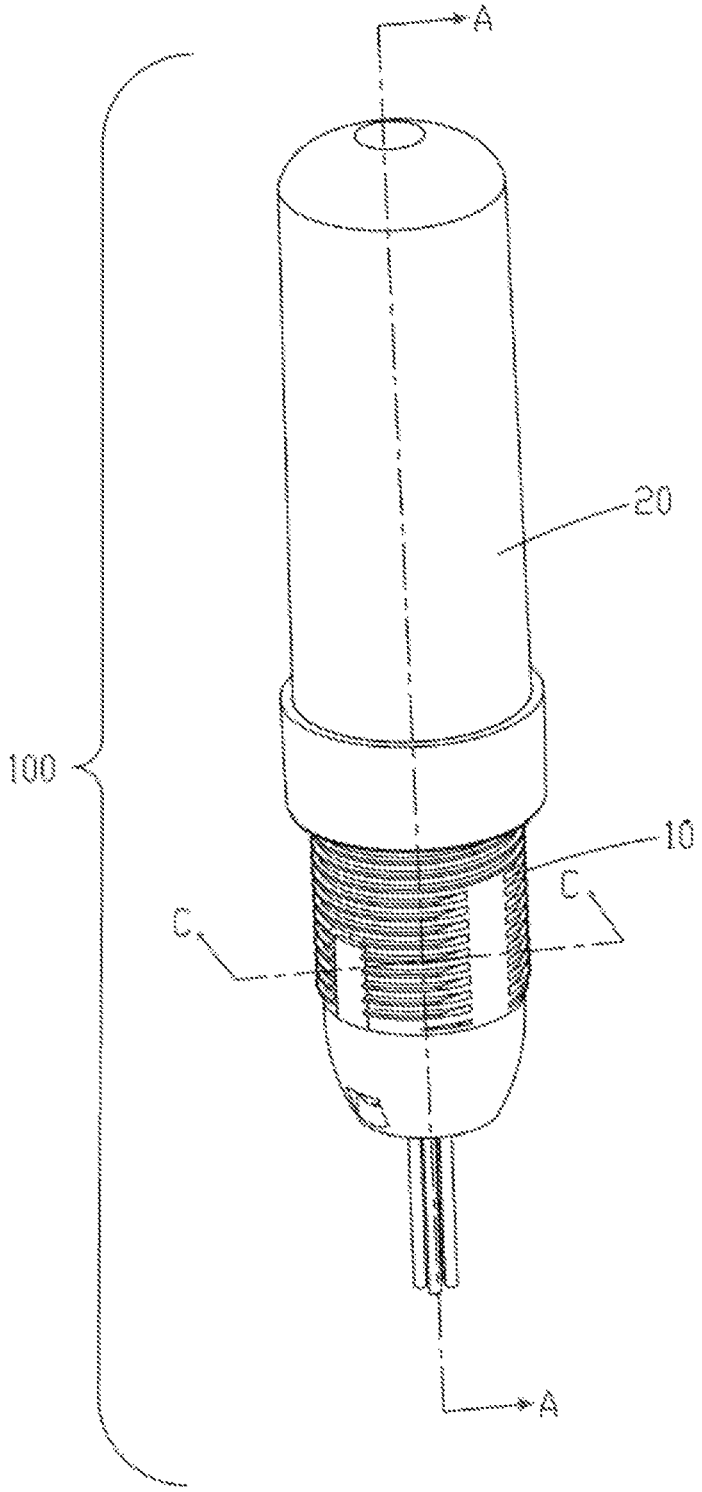
FIG. 1 is a stereoscopic view of a lighting device according to an example of the present disclosure.

In order to make objects, technical details and advantages of the present disclosure apparent, the technical solutions of the present disclosure will be described in a clearly and fully understandable way in connection with examples of the present disclosure and corresponding drawings. The described examples are just a part but not all of the examples of the present disclosure. Based on the examples of the present disclosure, those ordinarily skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise.

It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals referred in this application are provided below:

100—lighting device;

10—lamp socket connector; 11—docking portion; 111—clamp slot; 112—docking port; 113—docking channel; 114—baseplate; 1141—through hole; 115—baffle; 116—partition board; 1161—arcuate hole; 1162—central round hole; 1163—flange; 117—peripheral terminal; 118—central terminal; 119—inner wall; 1191—groove; 1192—foolproof notch; 1193—clamping notch; 120—base port; 12—base; 121—snap hook; 122—screw-threaded hole that allows a wire to pass through; 13—conducting wire;

20—light source module; 21—light-emitting assembly; 22—optical element; 23—pin; 24—connection pedestal; 241—guide boss.

In countries that use 220-240 volt AC domestic power, standard-size E27 and small E14 are the most common screw-mount sizes and are prevalent throughout continental Europe and China.

A lamp socket connector in accordance with specification E14 is thus widely used. A periphery of the lamp socket connector is provided with a screw mouth to be connected with an internal screw thread of the mounting pedestal; the screw mouth of the lamp socket connector is provided thereon with two terminals, in which one terminal is located at a dome of the screw mouth, and the other terminal is a screw body of the screw mouth. The internal screw thread of the mounting pedestal has two terminals electrically connected with the lamp socket connector, in which a round bottom in cooperation with the dome is one terminal of the internal screw thread of the mounting pedestal, and a screw body of the internal screw thread is the other terminal of the internal screw thread.

With diversified development of LED light sources and diversification of users' demands for luminous effects of the light source module, more and more LED light sources need to be able to implement dimming and toning control; however, some lamp socket connectors in accordance with specification E14 may not be able to satisfy the demands for dimming and toning of the light source module due to limitations of structures of the terminals and the number of the terminals, resulting in a problem that the light source module has a monotonous luminous effect.

An example of the present disclosure provides a lighting system, and the lighting system comprises a mounting pedestal, and a lighting device detachably coupled to (connected to) the mounting pedestal. The mounting pedestal is provided on a preset mounting region of the lighting device.

As illustrated in FIG. 1, in an example of the present disclosure, a lighting device 100 comprises a lamp socket connector 10 and a light source module 20 mounted on the lamp socket connector 10. The lamp socket connector 10 is configured to be connected and cooperated with the mounting pedestal, so as to position the lighting device 100 in a preset mounting region, and the light source module 20 obtains power required for operation through the mounting pedestal, to emit illumination light.

Hereinafter, structures of the light source module 20 and the lamp socket connector 10 in the lighting device 100, as well as a mutual connection relationship between the light source module 20 and the lamp socket connector 10 will be described in detail in conjunction with the accompanying drawings.

Figure 2:
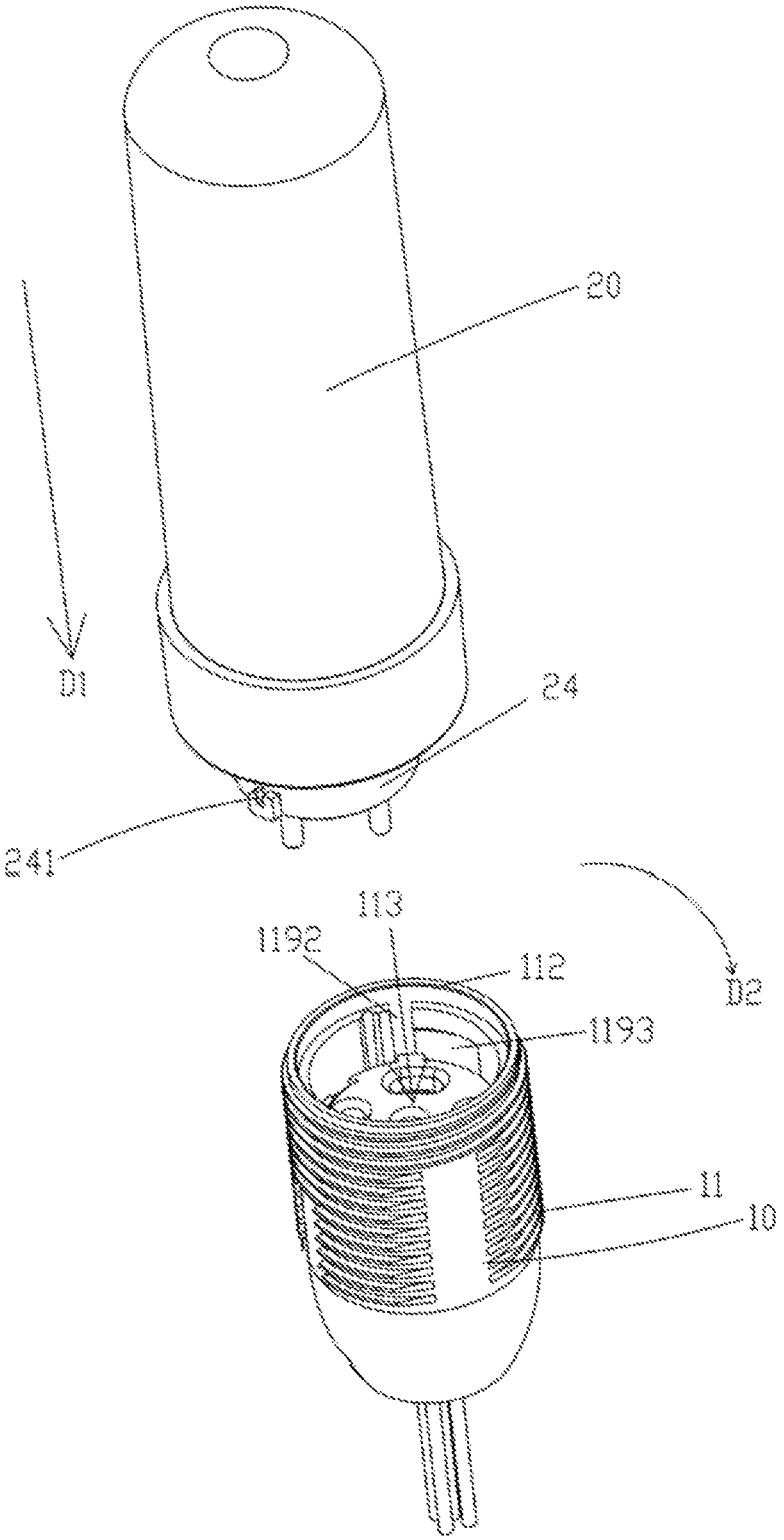
FIG. 2 is an exploded view of the lighting device as illustrated in FIG. 1.
Figure 3:
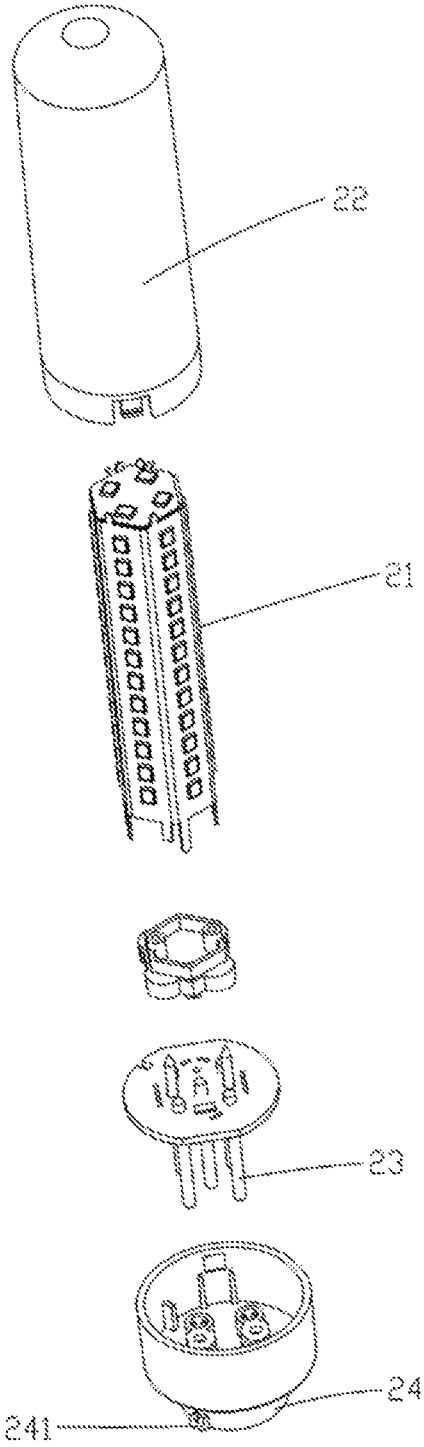
FIG. 3 is an exploded view of a light source module in the lighting device as illustrated in FIG. 2.

As illustrated in FIG. 2 and FIG. 3, the light source module 20 includes: a light-emitting assembly 21, an optical element 22 that covers and surrounds the light-emitting assembly 21, a pin 23 electrically connected with a light-emitting unit of the light-emitting assembly 21, and a connection pedestal 24 that forms an outer wall of the light source module 20 by docking with the optical element 22.

The connection pedestal 24 has a hollow cylindrical structure, its opening end is snap-fitted with the optical element 22, and its inner bottom surface opposite to the opening end is formed with a hole (not labeled) for the pin 23 to pass through. After the hole is aligned with the pin 23, the connection pedestal 24 is coupled to the optical element 22 while the pin 23 passes out of a wall of the light source module 20.

Two guide bosses 241 having unequal widths are formed on the outer wall of the connection pedestal 24, and the guide bosses 241 extend outwardly away from the outer wall of the connection pedestal 24.

The lamp socket connector 10 comprises a docking portion 11. The docking portion 11 is fabricated in accordance with specification E14. Specification E14 is an international standard for a size of a lamp cap in a lighting device, and is a specific limitation on a shape and a size of the docking portion 11, which will not be elaborated here. In actual application, an external thread in accordance with specification E14 may be provided on the outer wall of the docking portion 11, to directly fix the docking portion 11 onto the mounting pedestal in accordance with specification E14. Of course, the docking portion 11 may also be fabricated based on a specification other than E14, such as E12 or the like.

The docking portion 11 includes: a docking port 112 for docking with the light source module 20, a docking channel 113 extending from the docking port 112, and at least two socket terminals (not labeled) located in the docking channel 113. In actual application, the docking portion 11 may have a substantially long tubular shape, and the docking port 112 is opened at one end of the docking portion 11 and extends toward the inside of the docking portion 11 to form a substantially lengthwise docking channel 113.

In actual application, the socket terminals are arranged in the docking channel 113 and are not exposed; the connection pedestal 24 in the light source module 20 enters the docking channel 113, so that the pin 23 is plugged into the socket terminal, to realize both of physically connection and electrically connection between the docking portion 11 and the light source module 20.

In order to mechanically connect the light source module 20 with the lamp socket connector 10 more reliably, the guide bosses 241 and foolproof notches 1192 should be arranged more evenly in a circumferential direction.

Figure 4:
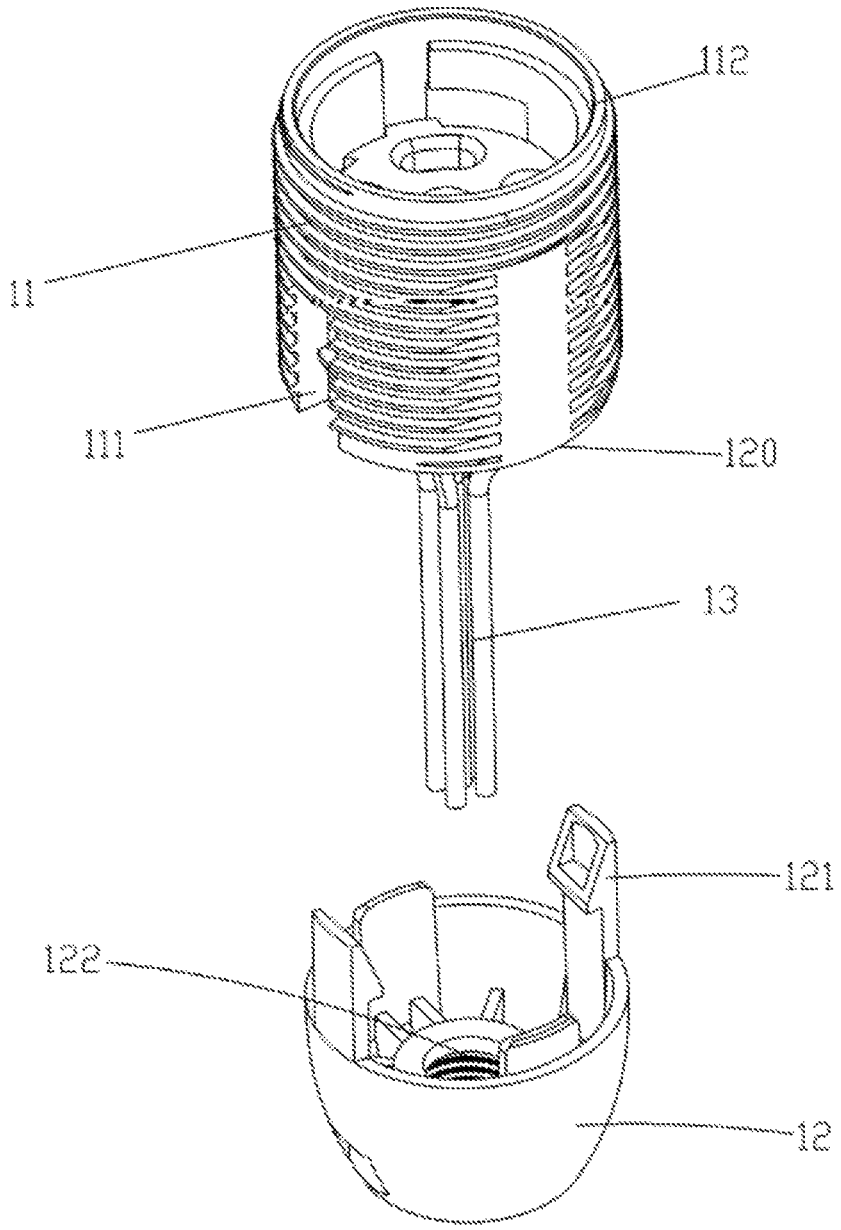
FIG. 4 is an exploded view of a lamp socket connector in the lighting device as illustrated in FIG. 2.

As illustrated in FIG. 4, the lamp socket connector 10 may further comprise a base 12; the docking portion 11 includes a base port 120 configured to face away from the docking port 112; and the base 12 is mounted onto the base port 120. In this example, the outer wall of the docking portion 11 is formed with a clamp slot 111; the base 12 is provided thereon with a snap hook 121 that protrudes from the base 12; and the clamp slot 111 and the snap hook 121 are snap-fitted.

The base 12 has a substantially bowl shape; the bowl shape has a hollow structure inside, and the base 12 a flat surface at the bottom; a pair of snap hooks 121 to be snap-fitted with the clamp slots 111 are symmetrically formed and extend in a direction from a wall of the base 12 toward the docking portion 11. On an end face of the base 12 that is away from the docking portion 11, a screw-threaded hole 122 that allows a wire to pass through is formed along an extension direction of the docking channel. A conducting wire 13 passes through the screw-threaded hole 122 that allows a wire to pass through and connects with the docking portion 11. The internal screw thread on the screw-threaded hole 122 that allows a wire to pass through can be interconnected with an external screw thread tube (not labeled) on the mounting pedestal, such that the base 12 is fastened to the mounting pedestal through the screw thread. In which, the external screw thread tube has a hollow structure for the conducting wire 13 to pass through.

Figure 5:
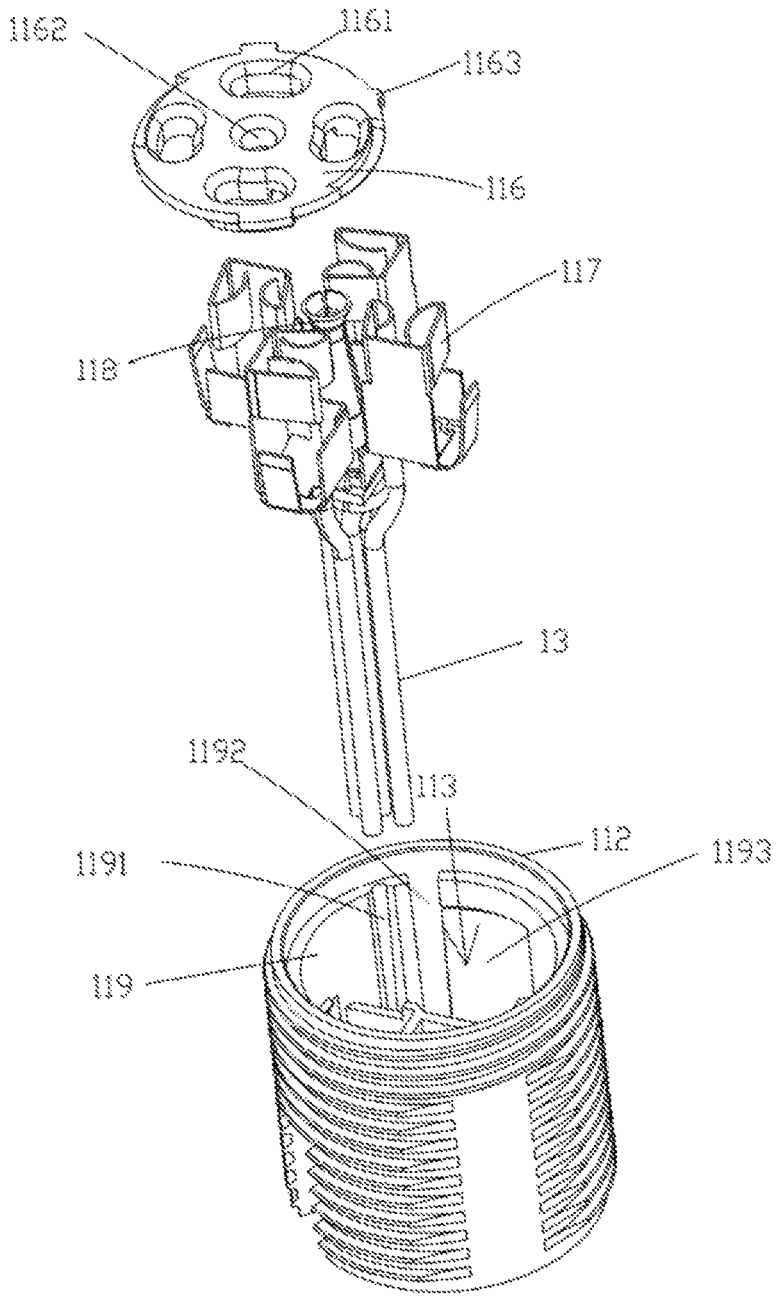
FIG. 5 is an exploded view of a docking portion in the lamp socket connector illustrated in FIG. 4.

As illustrated in FIG. 5, the socket terminals include four peripheral terminals 117 arranged on a same circumference with the same interval angles, and may further include a central terminal 118 located at the center of the circumference. Both the peripheral terminals 117 and the central terminal 118 are connected with the conducting wires 13. Of course, the socket terminals may also be arranged in other manners according to needs, for example, all of the socket terminals are arranged on the same circumference with the interval angles being different.

The central terminal 118 includes: a first support member (not shown) fixed to a mounting cavity and having a hole that allows a wire to pass through, a second support member (not shown) connected with the first support member, and an annular clamp member connected with the second support member. The second support member is in clip-connection with a conducting wire from the mounting pedestal, and the annular clamp member clamps a pin 23, to implement an electrical connection between the socket terminal and the pin 23.

Figure 6:
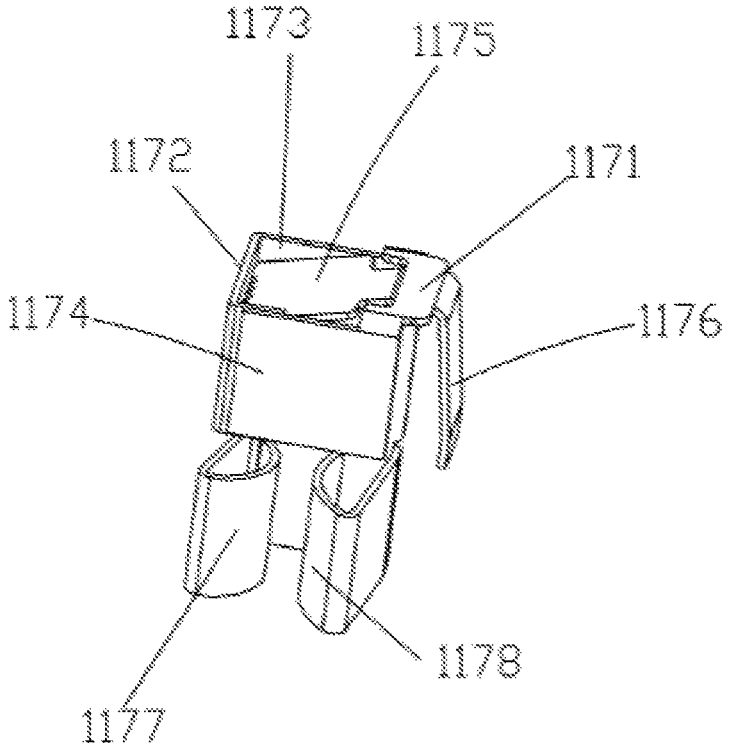
FIG. 6 is a schematic diagram of a peripheral terminal in the docking portion illustrated in FIG. 5.

As illustrated in FIG. 6, the peripheral terminal 117 has a wire receiving cavity (not labeled) electrically connected with the conducting wire, and a pin clamping cavity (not labeled) to be electrically connected with a pin 23 from the light source module 20. In which, the wire receiving cavity and the pin clamping cavity are respectively provided at both ends of the peripheral socket 117.

The peripheral terminal 117 includes a first portion 1171 and a second portion 1172 provided opposite to each other, as well as a third portion 1173 and a fourth portion 1174 provided opposite to each other; the third portion 1173 is connected with the first portion 1171 and the second portion 1172; the fourth portion 1174 is connected with the first portion 1171 and second portion 1172; and the first portion 1171, the second portion 1172, the third portion 1173 and the fourth portion 1174 form the wire receiving cavity for electrical connection with the conducting wire.

An edge of the first portion 1171 is elastically connected with a fifth portion 1175; the fifth portion 1175 extends into the wire receiving cavity and abuts against the second portion 1172; a semicircular notch (not shown) for the conducting wire to pass through is formed on the edge, that abuts against the second portion 1172, of the fifth portion 1175; when the conducting wire passes through the fifth portion 1175, the fifth portion 1175 is subjected to a force and further extends into the wire receiving cavity, and a distance between the edge, that abuts against the second portion 1172, of the fifth portion 1175 and the second portion 1172 becomes larger, so that the conducting wire passes through smoothly; and when the conducting wire stops penetrating, the fifth portion 1175 is released from the force and is reset toward an outer side of the wire receiving cavity, and the distance between the edge, that abuts against the second portion 1172, of the fifth portion 1175 and the second portion 1172 becomes smaller, so that the conducting wire is clamped between the second portion 1172 and the fifth portion 1175.

The first portion 1171 is further elastically connected with a sixth portion 1176; the sixth portion 1176 extends away from the wire receiving cavity; and the sixth portion 1176 and the fifth portion 1175 are respectively provided on two sides of the first portion 1171. After the peripheral terminal 117 is pressed into the mounting cavity of the docking channel 113 from the docking port 112, the sixth portion 1176 is squeezed so that the peripheral terminal 117 is clamped into the mounting cavity and is not easily detached from the mounting cavity.

In actual application, the fifth portion 1175 and the sixth portion 1176 may be integrally formed.

The third portion 1173 extend beyond the wire receiving cavity; a seventh portion 1177 and an eighth portion 1178 that are opposite to each other are provided in a region, that exceeds beyond the wire receiving cavity, of the third portion 1173; the seventh portion 1177 and the eighth portion 1178 are two similar C-shaped spring leafs that face away from each other; and a pin clamping cavity configured to clamp a pin 23 and be electrically connected with the pin 23 is formed between the seventh portion 1177 and the eighth portion 1178.

In actual application, the peripheral terminal 117 and the central terminal 118 may be formed by bending a metal conductive sheet, and both of the peripheral terminal 117 and the central terminal 118 have certain elasticity.

Referring back to FIG. 5, the lamp socket connector 10 further comprises a baffle 116; the baffle 116 has a circular plate shape, and is made of an insulating material such as rubber, which enters from the docking port 112 into the docking channel 113 through squeezing and covers the socket terminal.

The baffle 116 is formed thereon with a plug socket aligned with the pin 23, so that the pin 23 can pass through the plug socket to connect with the socket terminal. There are five plug sockets, including four arcuate holes 1161 arranged on a same circumference with the same interval angles, in which the four arcuate holes 1161 are aligned with the peripheral terminals 117; and a center of the arcuate holes 1161 overlaps a center of the baffle 116. The plug socket may further include a central round hole 1162 located at the center of the baffle 116 and aligned with the central terminal 118.

A flange 1163 is formed at the outer wall of the baffle 116 in a radial direction; a groove 1191 corresponding to the flange 1163 is formed in an inner wall 119 of the docking channel 113 along an axial direction; and the flange 1163 is clamped within the groove 1191, to implement foolproof assembly of the baffle 116 and the inner wall 119.

The inner wall 119 is provided thereon with a foolproof portion (not labeled), and the docking channel is non-centrally symmetrical in a cross-section where the foolproof portion is located, along an extension direction of the docking channel 113. In this example, the foolproof portion includes a foolproof notch 1192. The number of foolproof notches 1192 is two, and the two foolproof notches 1192 are provided on the inner wall 119 and opposite to each other, and have different widths. The number of foolproof notches may be only one, or three, four, and so on. Of course, the foolproof portion on the inner wall 119 may also be in a form of a foolproof projection or a combination of a foolproof projection and a foolproof notch.

A clamping notch 1193 connected with the foolproof notch 1192 is provided in a position on the inner wall 119 that is adjacent to the docking port 112; and the clamping notch 1193 is formed by extending from a guiding notch along a circumferential direction of the inner wall 119.

Figure 7:
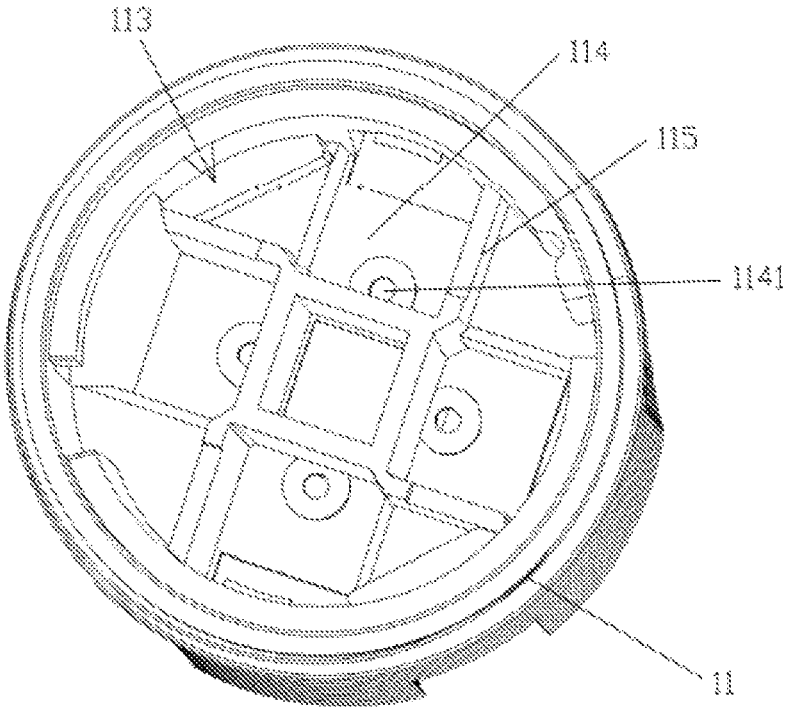
FIG. 7 is a schematic diagram of a docking channel in the docking portion illustrated in FIG. 5.

As illustrated in FIG. 7, the lamp socket connector 10 may further comprise a baseplate 114 located in the docking channel 113, and partition boards 115, in which the partition boards 115 are formed on the baseplate 114 and divide the docking channel 113 into a plurality of mounting cavities (not labeled); the baseplate 114 supports the socket terminal within the docking channel 113, that is, limits a position, along a depth direction, of the socket terminal within the docking channel 113.

Within the docking channel 113, the partition boards 115 in a "#" shape are formed on the baseplate 114 along the extension direction of the docking channel 113, and the partition boards 115 divide the docking channel into five mounting cavities. The five mounting cavities include four mounting cavities, that are arranged on a same circumference with the same interval angles and used for mounting the peripheral terminals 117, and the five mounting cavities may further include one mounting cavity having a square cross-section, in which the one mounting cavity is located at a center of the four mounting cavities and is used for mounting the central terminal 118. Of course, the partition boards may vary in form, and the number of mounting cavities for mounting socket terminals also varies with it. The baseplate 114 is formed thereon with a through hole 1141 for the conducting wire from the mounting pedestal to pass through, and the through hole 1141 is located on a region, which is between adjacent partition boards 115, of the baseplate 114.

Within the docking channel, the baffle 116 is provided parallel to the baseplate 114, and the baffle 116 is perpendicular to the extension direction of the channel, that is, the baffle 116 is perpendicular to the extension direction of the partition board 115, so that the baffle 116 can be reliably mounted in the docking channel and is not easily displaced.

Hereinafter, a connection relationship between the lamp socket connector 10 and the light source module 20 will be described in detail in conjunction with FIG. 2, and FIG. 8 to FIG. 11.

Figure 8:
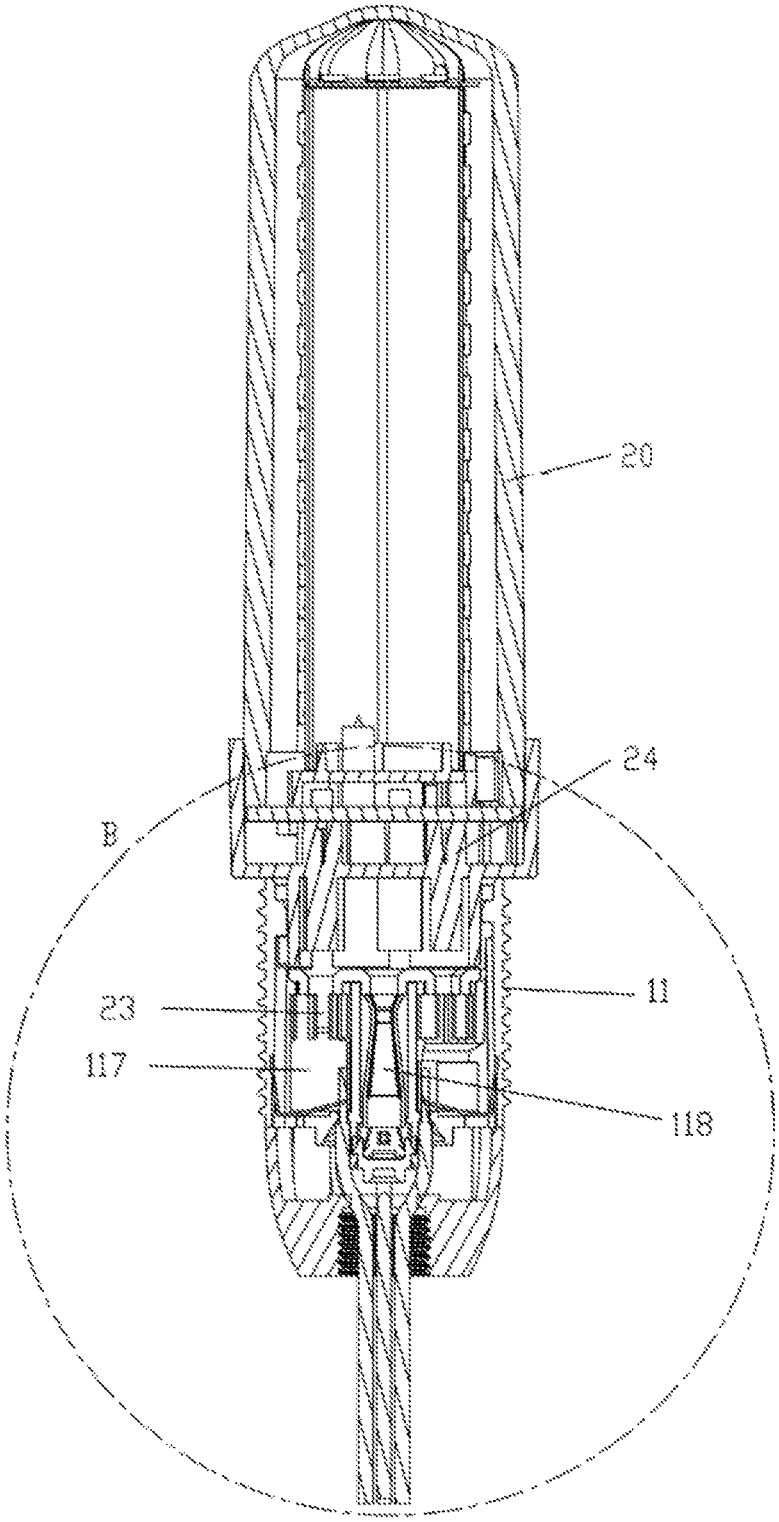
FIG. 8 is a cross-sectional view of the lighting device as illustrated in FIG. 1 taken along an A-A direction.
Figure 9:
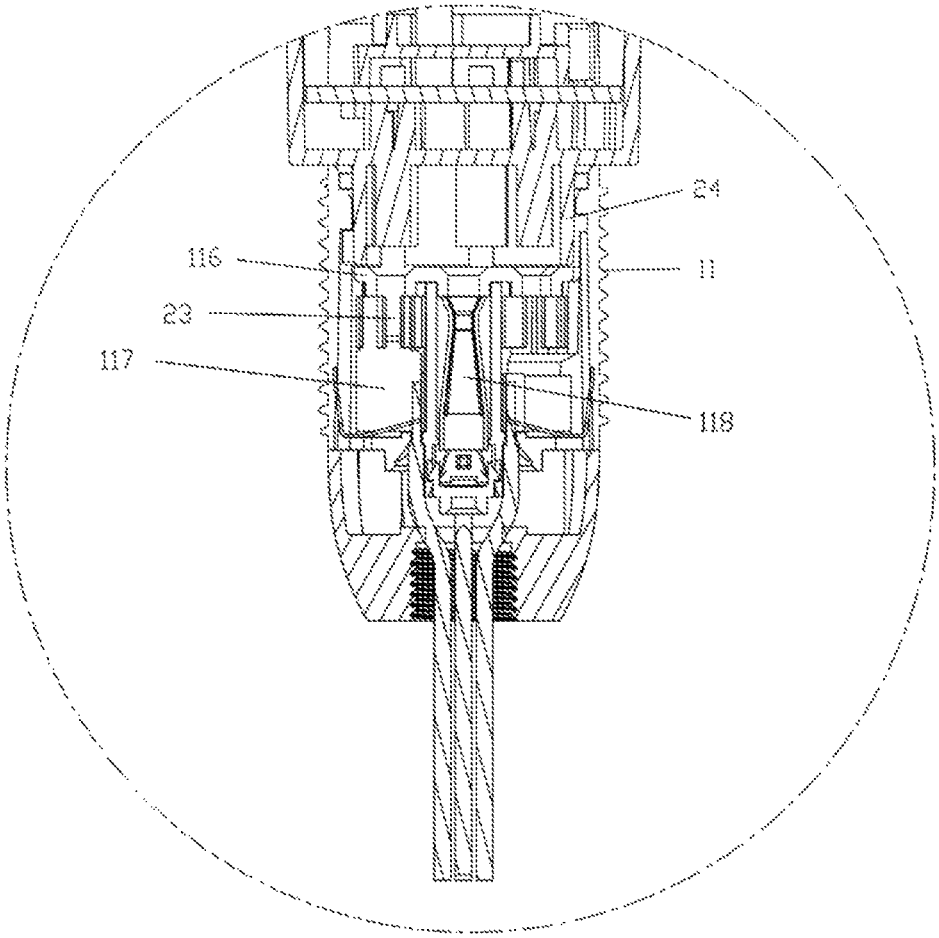
FIG. 9 is an enlarged view of the region B of the lighting device as illustrated in FIG. 8.
Figure 10:
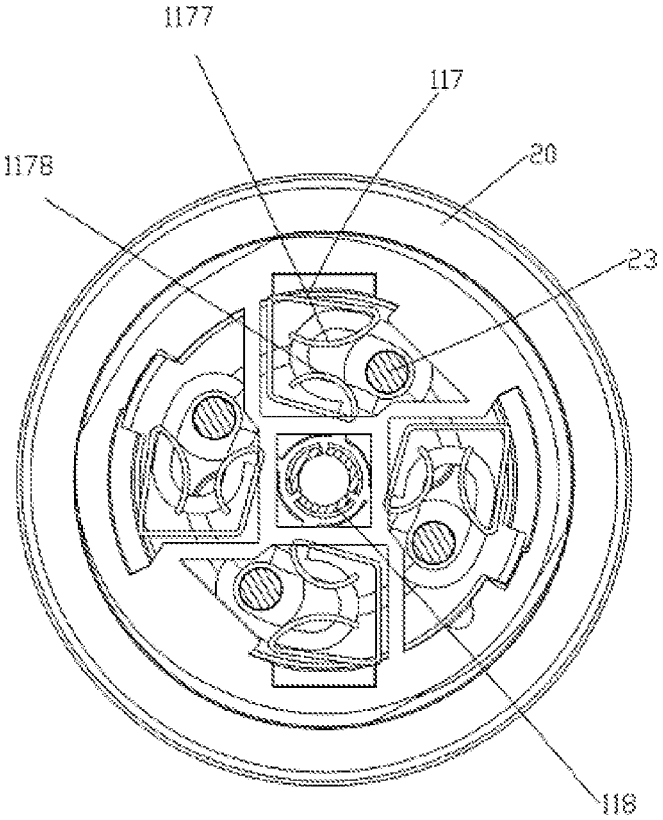
FIG. 10 is a cross-sectional view of the lighting device as illustrated in FIG. 1 taken along a C-C direction, when a pin is not clamped by a pin clamping cavity.
Figure 11:
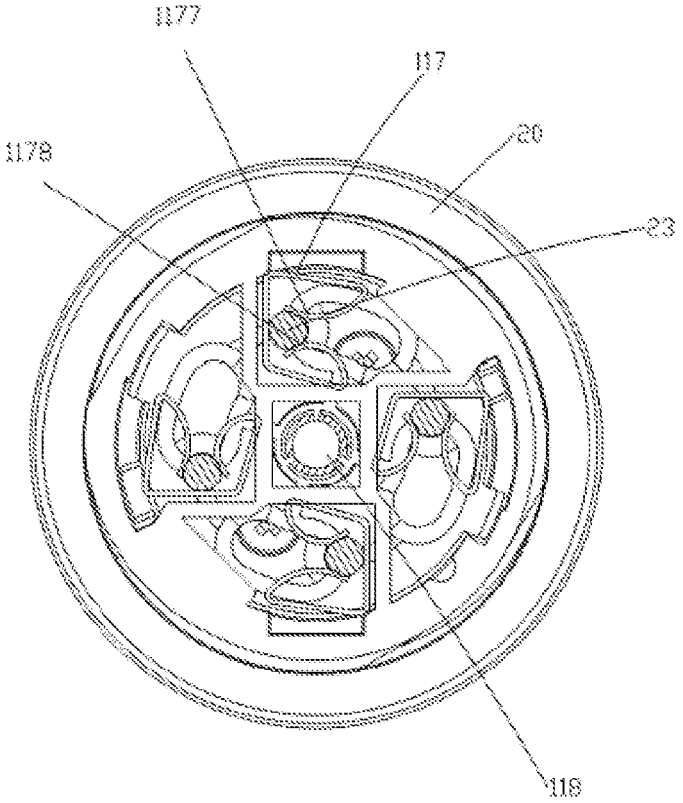
FIG. 11 is a cross-sectional view of the lighting device as illustrated in FIG. 1 taken along the C-C direction, when the pin is clamped by the pin clamping cavity.

The pin 23 of the light source module 20 is pushed toward the docking portion 11 along a D1 direction in FIG. 2, the guide boss 241 is aligned with the foolproof notch 1192; the connection pedestal 24 is plugged into the docking portion 11 from the docking port 112, the pin 23 passing through the plug socket to be plugged into the socket terminal, In which, the pins 23 at periphery are plugged into the peripheral terminals 117 and the central pin is plugged into the central terminal 118, to implement connection; with reference to FIG. 10, in the case where the pin 23 is not clamped, the pin 23 at periphery is located at a front end opening of the pin clamping cavity, having not reached the pin clamping cavity formed by the seventh portion 1177 and the eighth portion 1178 yet; as illustrated in FIG. 2, the light source module 20 is horizontally rotated in a D2 direction, the guide boss 241 enters the clamping notch 1193, to implement a mechanical connection between the light source module 20 and the lamp socket connector 10; at a same time, the pin 23 at periphery is switched from a state of FIG. 10 to a state of FIG. 11, that is, the pin 23 at periphery is screwed into the pin clamping cavity and is clamped by the seventh portion 1177 and the eighth portion 1178; and the central pin is still in connection with the central terminal 118. The light source module 20 and the docking portion 11 are connected with each other as illustrated in FIG. 8 and FIG. 9.

The lamp socket connector 10 according to the example of the present disclosure has at least two socket terminals, and two ends of each socket terminal are respectively connected with a conducting wire of the mounting pedestal and a pin of the light source module 20. The lamp socket connector 10, when having two socket terminals, can satisfy a requirement for realizing brightness adjustment of the light source module 20; when having three socket terminals, the lamp socket connector 10, can satisfy a requirement for realizing color temperature adjustment of the light source module 20; when having four socket terminals, the lamp socket connector 10 can satisfy a requirement for realizing RGB toning of the light source module 20; when having five socket terminals, the lamp socket connector 10 can satisfy a requirement for realizing RGBW toning of the light source module 20; and when having more socket terminals subsequently, the lamp socket connector 10 can satisfy requirements for realizing more complicated toning function. When the lamp socket connector 10 has five socket terminals, the light-emitting unit in the lighting device is a WRGB light-emitting unit, and there are five pins, which are respectively connected with a positive electrode, a pin of a W component, a pin of an R component, a pin of a G component and a pin of a B component of the WRGB light-emitting unit.

In the example of the present disclosure, the docking portion 11 may have only two, or three, or four mounting cavities therein. Similarly, the lamp socket connector 10 may have two, or three, or four, or more socket terminals therein; the light source module 20 has two, or three, or four, or more pins; and the baffle 116 is formed thereon with two, or three, or four, or more plug sockets.

In the example of the present disclosure, the lighting device 100 is mounted to a preset region such as a ceiling and a wall through the mounting pedestal, and may also be mounted, as a detachable component, into a lamp body of, for example, a desk lamp, a festive lantern, a decorative lamp, or a pendant lamp.

In this example, in order to achieve the objective of dimming and toning, the lighting system may have a control circuit electrically connected with the light source module 20, and the control circuit has a microcontroller unit (MCU).

The present disclosure provides a lamp socket connector for connecting a light source module, which can satisfy the demands for dimming and toning of the light source module.

The present disclosure provides a lamp socket connector including a docking portion. The docking portion comprises a docking port for docking with a light source module, a docking channel extending from the docking port, and at least two socket terminals in the docking channel.

Preferably, the docking portion is fabricated in accordance with specification E14.

Preferably, the at least two socket terminals comprise peripheral terminals on a same circumference.

Preferably, the at least two socket terminals further comprise a central terminal, and the central terminal is located at a center of the circumference where the peripheral terminals are located.

Preferably, the docking portion further comprises a baseplate in the docking channel and a plurality of partition boards on the baseplate; mounting cavities are formed between adjacent partition boards; and the socket terminals are mounted into the mounting cavities.

Preferably, a through hole is on a region, which is between adjacent partition boards, of the baseplate.

Preferably, the docking portion comprises a baffle within the docking channel; the baffle covers the socket terminals and comprises plug sockets aligned with the socket terminals.

Preferably, the baffle is parallel to the baseplate, and the baffle is perpendicular to an extension direction of the docking channel.

Preferably, the plug sockets comprise arcuate holes aligned with the peripheral terminals and a round hole aligned with the central terminal.

Preferably, a flange is on a periphery of the baffle; a groove is on an inner wall of the docking channel; and the flange is clamped in the groove.

Preferably, wherein each of the peripheral sockets comprises a first portion and a second portion which are opposite to each other, and comprises a third portion and a fourth portion which are opposite to each other; the third portion is connected with the first portion and the second portion; the fourth portion is connected with the first portion and second portion; the first portion, the second portion, the third portion and the fourth portion form a wire receiving cavity; an edge of the first portion is elastically connected with a fifth portion; and the fifth portion is configured to extend into the wire receiving cavity and abut against the second portion.

Preferably, the first portion is further elastically connected with a sixth portion; the sixth portion is configured to extend away from the wire receiving cavity; and the sixth portion and the fifth portion are respectively on two sides of the first portion.

Preferably, the fifth portion and the sixth portion are integrally formed.

Preferably, the third portion extends beyond the wire receiving cavity; a seventh portion and an eighth portion that are opposite to each other are provided in a region, which exceeds beyond the wire receiving cavity, of the third portion; and a pin clamping cavity is formed between the seventh portion and the eighth portion.

Preferably, an inner wall of the docking channel is provided thereon with a foolproof portion.

Preferably, the docking portion further comprises a base port that faces away from the docking port; and the lamp socket connector further comprises a base mounted to the base port.

Preferably, the base has a bowl shape.

Preferably, the base is provided with a screw-threaded hole that allows a wire to pass through.

Preferably, the base is provided with a snap hook protruding toward the docking portion, an outer wall of the docking portion is provided with a clamp slot; and the snap hook and the clamp slot are snap-fitted.

Preferably, a periphery of the docking portion has a screw thread.

The present disclosure further provides a lighting device, which comprises:

any one of the above-mentioned lamp socket connectors; and a light source module, in which the light source module is mounted to the docking port of the lamp socket connector; the light source module comprises a light-emitting unit and at least two pins electrically connected with the light-emitting unit; and the pins are plugged into the socket terminals.

Preferably, the light-emitting unit is a WRGB light-emitting unit, and the light source module comprises five pins which are respectively connected with a positive electrode, a pin of a W component, a pin of an R component, a pin of a G component and a pin of a B component of the WRGB light-emitting unit.

The present disclosure further provides a lighting system, which comprises:

any one of the above-mentioned lighting devices; and a mounting pedestal that is in accordance with specification E14 and fixed to a preset mounting region, in which the lamp socket connector in the lighting device is mounted to the mounting pedestal.

As compared with the other implementations, with respect to the lamp socket connector, a lighting device and a lighting system provided by the present disclosure, the lamp socket connector has a docking portion in accordance with specification E14; and the docking portion includes a docking port for docking with the light source module, a docking channel formed by extending from the docking port, and at least two socket terminals located in the docking channel. The lamp socket connector having a plurality of socket terminals can satisfy the demands for dimming and toning of the light source module, and implements diversification of luminous effects.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The purpose, technical solutions and advantageous effects of the present disclosure are further explained in detail in the examples as described above. It should be understood that the foregoing examples merely are some examples of the present disclosure, and not intended to limit the present disclosure. Any modification, equivalent substitution, improvement, and the like, made within the spirit and principles of the present disclosure should be covered within the protection scope of the present disclosure.

What is claimed is:

1. A lamp socket connector, comprising: a docking portion, wherein the docking portion comprises:

a docking port for docking a light source module;

a docking channel extending from the docking port;

at least two socket terminals in the docking channel;

a baseplate in the docking channel and a plurality of partition boards on the baseplate; and mounting cavities formed between adjacent partition boards, wherein the at least two socket terminals are mounted into the mounting cavities.

2. The lamp socket connector according to claim 1, wherein the docking portion is fabricated in accordance with specification E14.

3. The lamp socket connector according to claim 2, wherein the at least two socket terminals comprise peripheral terminals on a circumference.

4. The lamp socket connector according to claim 3, wherein the at least two socket terminals further comprise a central terminal, and the central terminal is located at a center of the circumference where the peripheral terminals are located.

5. The lamp socket connector according to claim 1, wherein a through hole is on a region, which is between adjacent partition boards, of the baseplate.

6. The lamp socket connector according to claim 1, wherein the docking portion comprises a baffle within the docking channel, and wherein the baffle covers the socket terminals and comprises plug sockets aligned with the socket terminals.

7. The lamp socket connector according to claim 6, wherein the baffle is parallel to the baseplate, and the baffle is perpendicular to an extension direction of the docking channel.

8. The lamp socket connector according to claim 6, wherein the plug sockets comprise arcuate holes aligned with the peripheral terminals and a round hole aligned with the central terminal.

9. The lamp socket connector according to claim 6, wherein:

a flange is on a periphery of the baffle;

a groove is on an inner wall of the docking channel; and the flange is clamped in the groove.

10. The lamp socket connector according to claim 4, wherein each of the peripheral terminals comprises a first portion and a second portion which are opposite to each other, and a third portion and a fourth portion which are opposite to each other; and wherein:

the third portion is connected with the first portion and the second portion;

the fourth portion is connected with the first portion and second portion;

the first portion, the second portion, the third portion and the fourth portion form a wire receiving cavity;

an edge of the first portion is elastically connected with a fifth portion; and the fifth portion is configured to extend into the wire receiving cavity and abut against the second portion.

11. The lamp socket connector according to claim 10, wherein the first portion is further elastically connected with a sixth portion; and wherein:

the sixth portion is configured to extend away from the wire receiving cavity; and the sixth portion and the fifth portion are respectively on two sides of the first portion.

12. The lamp socket connector according to claim 11, wherein the fifth portion and the sixth portion are integrally formed.

13. The lamp socket connector according to claim 10, wherein:

the third portion extends beyond the wire receiving cavity;

a seventh portion and an eighth portion that are opposite to each other are provided in a region, which exceeds beyond the wire receiving cavity, of the third portion; and a pin clamping cavity is formed between the seventh portion and the eighth portion.

14. The lamp socket connector according to claim 1, wherein an inner wall of the docking channel is provided thereon with a foolproof portion.

15. The lamp socket connector according to claim 1, wherein the docking portion further comprises a base port that faces away from the docking port; and the lamp socket connector further comprises a base mounted to the base port.

16. The lamp socket connector according to claim 15, wherein the base is provided with a screw-threaded hole that allows a wire to pass through.

17. The lamp socket connector according to claim 15, wherein the base is provided with a snap hook protruding toward the docking portion, an outer wall of the docking portion is provided with a clamp slot; and the snap hook and the clamp slot are snap-fitted.

18. A lighting device, comprising:

a lamp socket connector that comprises a docking portion, wherein the docking portion comprises: a docking port for docking a light source module; a docking channel extending from the docking port; at least two socket terminals in the docking channel; a baseplate in the docking channel and a plurality of partition boards on the baseplate; and mounting cavities formed between adjacent partition boards, wherein the at least two socket terminals are mounted into the mounting cavities; and a light source module, wherein the light source module is mounted to the docking port of the lamp socket connector; the light source module comprises a light-emitting unit and at least two pins electrically connected with the light-emitting unit; and the pins are plugged into the socket terminals; and wherein the light-emitting unit is a WRGB light-emitting unit, and the light source module comprises five pins which are connected with a positive electrode, a pin of a W component, a pin of an R component, a pin of a G component and a pin of a B component of the WRGB light-emitting unit.

19. A lighting system, comprising:

a lighting device, wherein the lighting device comprises: a lamp socket connector that comprises a docking portion, wherein the docking portion comprises: a docking port for docking a light source module; a docking channel extending from the docking port; at least two socket terminals in the docking channel; a baseplate in the docking channel and a plurality of partition boards on the baseplate; and mounting cavities formed between adjacent partition boards, wherein the at least two socket terminals are mounted into the mounting cavities; and a light source module, wherein the light source module is mounted to the docking port of the lamp socket connector; the light source module comprises a light-emitting unit and at least two pins electrically connected with the light-emitting unit; and the pins are plugged into the socket terminals; and a mounting pedestal that is fixed to a preset mounting region, wherein the lamp socket connector in the lighting device is mounted to the mounting pedestal.

* * * * *